United States Patent [19]

Hornblad et al.

[11] Patent Number: 4,640,029

[45] Date of Patent: Feb. 3, 1987

[54] MOBIUS STRIP AND DISPLAY UTILIZING THE SAME

[75] Inventors: Richard P. Hornblad, Shorewood; Gerald R. Sorensen, Milwaukee, both of Wis.

[73] Assignee: DCI Marketing, Milwaukee, Wis.

[21] Appl. No.: 638,861

[22] Filed: Aug. 7, 1984

Related U.S. Application Data

[63] Continuation-in-part of Ser. No. 491,741, May 5, 1983, abandoned.

[51] Int. Cl.[4] ..... G09F 11/18

[52] U.S. Cl. ..... 40/5; 40/518

[58] Field of Search ..... 40/525, 524, 5, 10 R, 40/118, 514, 529, 518

[56] References Cited

U.S. PATENT DOCUMENTS

| | | | |
|---|---|---|---|
| 1,426,845 | 8/1922 | Humble et al. | 248/459 |
| 3,010,425 | 11/1961 | Peavey, Jr. | 40/525 |
| 3,016,638 | 1/1962 | Singer | 40/5 |
| 3,939,584 | 2/1976 | Frame | 40/576 |
| 4,216,599 | 8/1980 | Eckert | 40/451 |

FOREIGN PATENT DOCUMENTS

| | | | |
|---|---|---|---|
| 408389 | 12/1923 | Fed. Rep. of Germany | 40/5 |
| 624570 | 6/1949 | United Kingdom | 40/524 |
| 6625 | 2/1985 | United Kingdom | 40/524 |

*Primary Examiner*—Gene Mancene
*Assistant Examiner*—Cary E. Stone

[57] ABSTRACT

A display device comprising a display panel having a window therein, a flat continuous tape in the form of a mobius strip having indicia on both sides thereof, and a support member removably secured to the display panel such that a portion of the tape is supported between the display panel and the support member so that a portion of the tape and the indicia thereon are displayed in the window.

9 Claims, 8 Drawing Figures

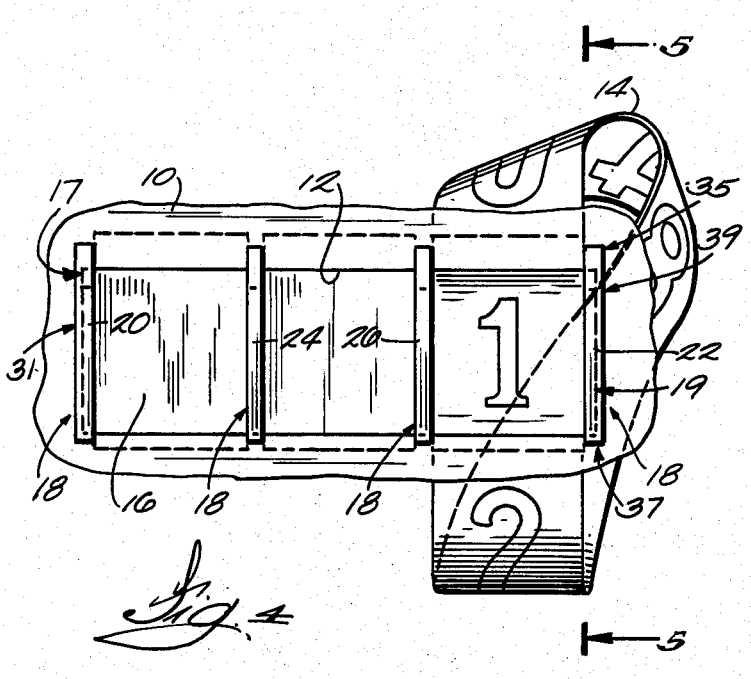
Fig. 4
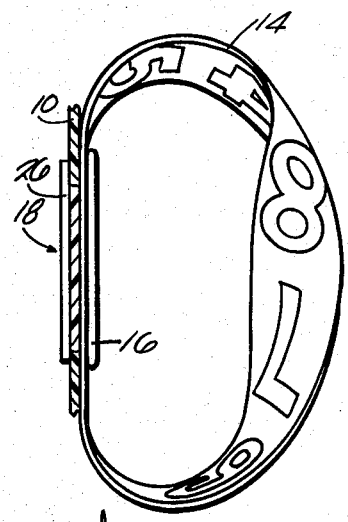
Fig. 5
Fig. 6
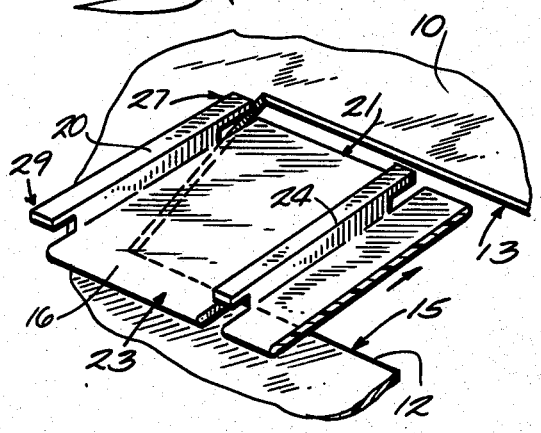
Fig. 7
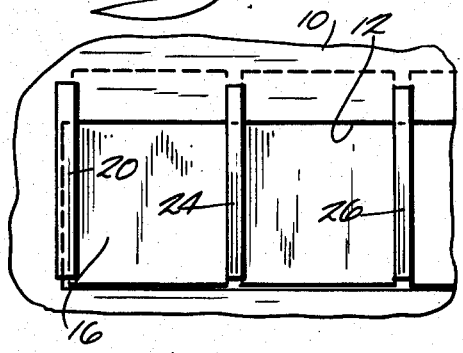
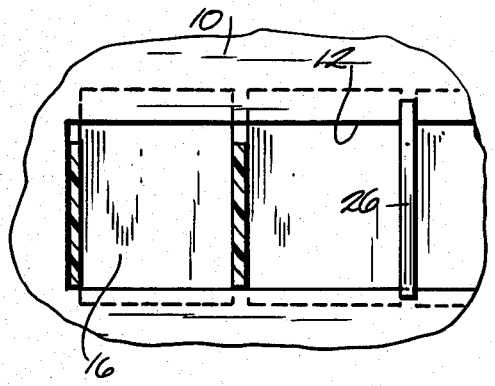
Fig. 8

MOBIUS STRIP AND DISPLAY UTILIZING THE SAME

RELATED APPLICATION

This application is a continuation-in-part of application Ser. No. 491,741, now abandoned, filed May 5, 1983 and entitled "Mobius Strip and Display Utilizing the Same."

BACKGROUND OF THE INVENTION

Many signs use pre-curled strips which display numerals or other indicia and run in tracks or guides in the sign with the curled ends of the strip behind the sign. In order to change the display the strip is moved as appropriate to change the indicia in the display aperture. Not infrequently, the person changing the price overshoots the end of the strip removing the strip from the sign. Then the sign has to be taken down and the strip put back into position. That is a nuisance.

SUMMARY OF THE INVENTION

The object of this invention is to eliminate the possibility of the strip being pushed out of the aperture. This is done by using a Mobius strip which is a classic geometric form made starting with a flexible strip, turning one end 180° relative to the other, and then gluing the ends together. As is well known, if you start on one side of a Mobius strip and follow around, you progress onto the other side of the strip. Or, you have an interesting philosophical question . . . is there one side or two sides to the strip . . . in this application the strip will be considered to have two sides. If numerals or other indicia are applied to both sides of the strip, all the indicia on the strip will appear in a window as the strip moves past the window. It is impossible to push the strip past the window since the ends are glued together. This eliminates the problems associated with the prior art pre-curled price strips.

The use of the Mobius price strip has two problems. One, more space is required in back of the display board since the Mobius strip occupies more space. The other problem is that the strip lies directly back of the board and would interfere with back lighting the numeral. Furthermore, since there are indicia on both sides you can't readily use transmitted light. But, there are many instances where back lighting is not used and this strip is useful.

This invention has a distinct advantage over a strip having indicia on one side only and having its ends glued together. That sort of construction results in too much tape or strip back of the sign.

BRIEF DESCRIPTION OF THE DRAWINGS

FIG. 4 is a fragmentary front view of an alternative embodiment of the invention.

FIG. 5 is a cross-sectional view taken along line 5—5 in FIG. 4.

FIG. 6 is a fragmentary perspective view of the device shown in FIG. 4 wherein the support member is positioned for insertion into the display panel.

FIG. 7 is a fragmentary front view of the display device wherein the support member is partially inserted into the display panel.

FIG. 8 is a fragmentary front view of the display device wherein the support member is completely inserted into the display panel.

DETAILED DESCRIPTION OF THE DRAWINGS

Figure 1:
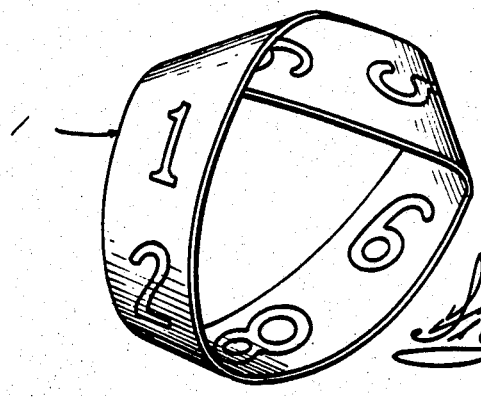
FIG. 1 is a perspective view of a Mobius strip having numerals printed on both sides of the strip.

FIG. 1 illustrates the well-known Mobius strip. In this case the strip has numerals printed on both sides of the strip or tape 1. Any other desired indicia can be printed on the tape. The tape is desirably flexible and opaque so that indicia on the reverse side of the tape cannot show through. By way of brief review, it will be appreciated that a Mobius strip is formed by twisting one end of a flat tape relative to the other and then gluing or otherwise securing the ends together. Obviously, with such a strip twice as many indicia can be applied to a tape of a given length (prior to securing the ends) than can be applied to a tape utilizing only one side of the tape.

Figure 2:
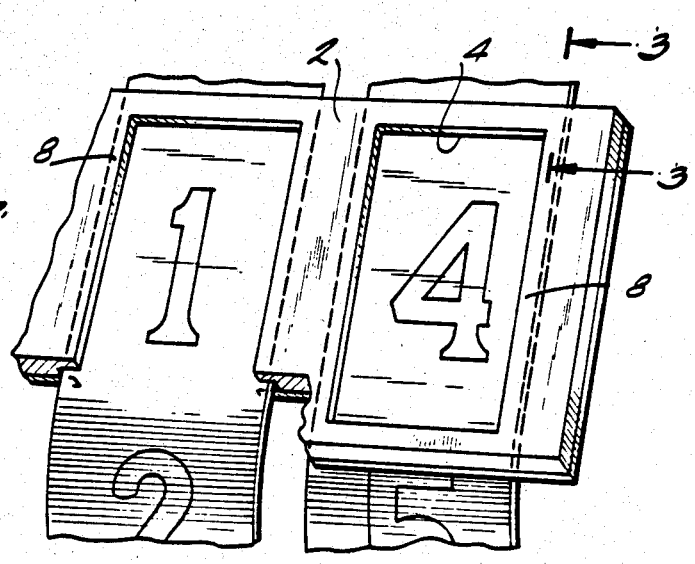
FIG. 2 is a fragmentary perspective view with parts broken away of a display sign or panel using the Mobius strip shown in FIG. 1.
Figure 3:
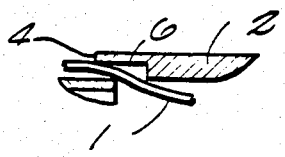
FIG. 3 is an enlarged partial section of FIG. 2 in line 3—3.

FIG. 2 is a schematic representation of how the tape might be used in a display sign. The tape is mounted in the display panel 2 so that it passes under an aperture or window 4 through which the indicia are displayed. The tape is then threaded through slots 6 to the backside of the panel. The sides of the aperture have an overhanging lip 8 and the ends have an overhang to guide and restrain the tape. After the tape is mounted, one end is twisted relative to the other and the ends are secured together to make the Mobius strip shown in FIG. 1 but it is captured in the panel. Obviously, the strip will need a little more room behind the panel to accommodate the twisted shape of the strip back of the panel (as may be seen in the right portion of the perspective view of FIG. 1). Also, the tape would lie between any back lighting source and the aperture or window 4 but there are many instances where back lighting is not necessary and is not used. This arrangement is well suited to that purpose. Obviously the user cannot push the tape out of the window.

This arrangement overcomes the problems associated with use of the pre-curled tapes or strips of the prior art but can't replace all of the uses of those pre-curled tapes.

It will be obvious the panel can be designed to allow a pre-glued tape to slip into position from the side to be retained by guide lugs or the like. This avoids gluing the ends after the tape is fed through slots and may be better suited to production of signs. Field installation in which the tape is glued after installation has advantage in that the tapes are flat prior to installation and are easier to handle.

Illustrated in FIG. 4 is an alternative embodiment of the display device of the invention. The display device comprises a display panel 10 (shown fragmentarily in FIG. 4) that can be supported by any suitable means. For example, the display panel 10 could form one side of a rectangular housing. The display panel 10 has therein a generally rectangular window 12, and the display panel 10 includes a front surface 11, opposite first and second or upper and lower edges 13 and 15, respectively, and opposite third and fourth or left and right edges 17 and 19, respectively (as viewed in FIG. 4) defining the window 12.

The display device also comprises a flat tape or mobius strip 14 such as the one illustrated in FIG. 1. The strip or tape 14 has indicia on both sides. The display device also comprises a support member 16 having opposite first and second or upper and lower ends 21 and 23, respectively, and means for removably securing the support member 16 to the display panel 10 such that the support member 16 is generally parallel to and supported from the display panel 10 adjacent the window 12, and such that a portion of the tape or mobius strip 14 is supported between the support member 16 and the display panel 10. The tape 14 is supported so that a portion of the tape 14 and the indicia thereon are displayed in the window 12. The remainder of the tape 14 extends behind the support member 16, and as is best shown in FIG. 5 and as is the case with the display sign shown in FIG. 2, the portion of the tape 14 (most of the tape 14) that is not supported between the support member 16 and the display panel 10 hangs unsupported behind the display panel 10.

It should be noted that while only one mobius strip is shown in FIG. 4, the display device illustrated in FIGS. 4 through 8 is adapted to support three strips. The manner in which the three strips are to be supported is described below.

While various suitable means can be employed for removably securing the support member 16 to the display panel 10, in the illustrated construction such means includes projection means 18 extending from the support member 16 and being adapted to extend through the window 12 and to engage the front surface of the display panel 10. In the preferred embodiment, the projection means 18 includes a first or left projection 20, and a second or right projection 22. The first projection 20, which is best illustrated in FIG. 6, has a main portion extending upwardly or outwardly from the left end of the support member 16, a first end 27 adapted to engage the front surface 11 of the display panel 10 adjacent the upper edge 13, a second end 29 adapted to engage the front surface 11 of the display panel 10 adjacent the lower edge 15, and a side portion 31 adapted to engage the front surface 11 of the display panel 10 adjacent the left edge 17. The second projection 22 includes a main portion extending upwardly or outwardly from the right end of the support member 16, a first end 35 adapted to engage the front surface 11 of the display panel 10 adjacent the upper edge 13, a second end 37 adapted to engage the front surface 11 of the display panel 10 adjacent the lower edge 15, and a side portion 39 adapted to engage the front surface 11 of the display panel 10 adjacent the right edge 19.

Describing the projection means 18 in other terms, the first ends 27 and 35 of the first and second projections 20 and 22 combine with the upper end 21 of the support member 16 to form notches for receiving the upper edge 13 of the display panel 10, and the second ends 29 and 37 of the projections 20 and 22 combine with the lower end 23 of the support member 16 to form notches for receiving the lower edge 15 of the display panel 10.

As mentioned above, the display device shown in FIGS. 4 through 8 is adapted to support three mobius strips or tapes. Thus, in addition to the first and second projections 20 and 22, respectively, the means for removably securing the support member 16 to the display panel 10 also includes third and fourth projections 24 and 26, respectively, spaced between and generally parallel to the first and second projections. Each of the third and fourth projections 24 and 26, respectively, includes a main portion extending upwardly or outwardly from the support member 16, a first end adapted to engage the front surface of the display panel 10 adjacent the upper edge, and a second end adapted to engage the front surface of the display panel 10 adjacent the lower edge. The projections are spaced such that one strip fits between the first and third projections 20 and 24, respectively, one strip fits between the third and fourth projections 24 and 26, respectively, and one strip fits between the fourth and second projections 26 and 22, respectively. In FIG. 4, the strip 14 is shown between the fourth and second projections.

The support member 16 is shown being inserted into the display panel 10 in FIGS. 6 through 8. While the tape 14 is not shown in FIGS. 6 through 8, it is intended that the tape or tapes be in position on the support member 16 while the support member 16 is being inserted into the display panel 10. Thus, the portion of the tape 14 that is unsupported by the support member 16 should be inserted through the window 12 before the support member 16 is inserted into the display panel 10.

In FIG. 6 the support member 16 is shown in position to be inserted into the display panel 10. The support member 16 is slightly below the window 12, and the first or upper end of the support member 16 is angled into the window 12 so that when the support member 16 is moved upwardly the upper edge of the display panel 10 will slide between the upper end of the support member 16 and the projections 20, 22, 24 and 26. When the support member 16 is moved upwardly or in the direction of the arrow in FIG. 6, the upper edge of the display panel 10 will slide between the upper end of the support member 16 and the projections 20, 22, 24 and 26 until the support member reaches the position shown in FIG. 7. When the support member 16 is in the position shown in FIG. 7, the main portions of the projections 20, 22, 24 and 26 abut the upper edge of the display member 10 so that the support member 16 cannot be moved further upwardly relative to the display panel 10. The next step in inserting the support member 16 into the display panel 10 is to slide the support member 16 downwardly or toward the lower edge of the display panel 10 so that the lower edge is between the lower end of the support member 16 and the lower ends of the projections 20, 22, 24 and 26, as shown in FIG. 8. That is, the upper and lower ends 21 and 23 of the support member 16 are opposed to the rear surface of the display panel 10, and ends 27, 29, 35, and 37 of the first and second projections 20 and 22 are opposed to the front surface 11. When the support member 16 reaches this position, insertion is completed. The tape or tapes will be supported between the support member 16 and the rear surface of the display panel 10 with a portion of the tape or tapes being displayed in the window 12, as shown in FIG. 4.

It should be understood that the display device of the invention can be modified to accommodate any number of tapes.

We claim:

1. A display device comprising a display panel having oppositely facing generally parallel front and back surfaces, means defining a window in said display panel, a support member having a generally planar surface arranged parallel to and oppposed to said back surface of said display panel, means on said support member defining planar projection surfaces spaced along said support member and lying in a plane parallel to but spaced apart from the plane of said planar surface of said support member, said planar projection surfaces being arranged to overlap said front surface of said display panel adjacent opposite sides of said window, and said planar surface of said support member being arranged to engage said back surface of said display panel, and means on said support member defining notches between said planar projection surfaces and said planar surface of said support member sufficient to permit said support member to move relative to said display panel so that said planar projection surfaces can be selectively moved to clear said front surface of said display panel to permit removal of said support member from said display panel, and a flat continuous tape in the form of a loop and having a 180° twist therein so as to form a mobius strip, said tape having indicia on both sides thereof and being supported by said support member in said window.

2. A display device comprising a display panel having opposite front and back surfaces and a window therein, said window being generally rectangular and having first and second opposite edges, a flat continuous tape in the form of a loop and having a 180 degree twist therein so as to form a mobius strip, said tape having indicia on both sides thereof, a support member having a first end adapted to be closely spaced from said back surface of said display panel adjacent said first edge and an opposite second end adapted to be closely spaced from said back surface of said display panel adjacent said second edge, and projection means extending from said support member for removably securing said support member to said display panel such that said support member is generally parallel to said display panel, and such that a portion of said tape is supported between said display panel and said support member so that a portion of said tape and said indicia thereon are displayed in said window in said display panel, said projection means including a first projection having a first end adapted to engage said front surface of said display panel adjacent said first edge and a second end adapted to engage said front surface of said display panel adjacent said second edge.

3. A display device as set forth in claim 2 wherein said projection means further includes a second projection having a first end adatped to engage said front surface of said display panel adjacent said first edge and a second end adapted to engage said front surface of said display panel adjacent said second edge, said first and second projections being generally parallel and adapted to support said tape therebetween.

4. A display device as set forth in claim 3 wherein said display panel further includes a third edge transverse to and interconnecting said first and second edges, and wherein said first projection has a side portion adapted to engage said front surface of said display panel adjacent said third edge.

5. A display device as set forth in claim 4 wherein said display panel further includes a fourth edge opposite said third edge and interconnecting said first and second edges, and wherein said second projection has a side portion adapted to engage said front surface of said display panel adjacent said fourth edge.

6. A display device comprising a display panel having a window therein and having first and second opposite edges defining said window, a flat continuous tape in the form of a loop and having a 180 degree twist therein so as to form a mobius strip, said tape having indicia on both sides thereof, a support member having opposite first and second ends, and projection means extending from said support member for removably securing said support member to said display panel such that said support member is generally parallel to said display panel, and such that a portion of said tape is supported between said display panel and said support member so that a portion of said tape and said indicia thereon are displayed in said window in said display panel, said projection means includes a plurality of projections each having a first end adjacent to and spaced from said first end of said support member so as to form a notch adapted to receive said first edge of said display panel, and a second end adjacent to and spaced from said second end of said support member so as to form a notch adapted to receive said second edge of said display panel, so that said support member is engageable with said display panel by sliding said support member in one direction so that said first edge of said display panel is received between said first end of said support member and said first ends of said projections, and by sliding said support member in the opposite direction so that said second edge of said display panel is received between said second end of said support member and said second ends of said projections.

7. A display device comprising a display panel having opposite front and back surfaces and a window therein, said window being generally rectangular and having first and second opposite edges, a flat continuous tape in the form of a loop and having indicia thereon, a support member having a first end adapted to be closely spaced from said back surface of said display panel adjacent said first edge and an opposite second end adapted to be closely spaced from said back surface of said display panel adjacent said second edge, and projection means extending from said support member for removably securing said support member to said display panel such that said support member is generally parallel to said display panel, and such that a portion of said tape is supported between said display panel and said support member so that a portion of said tape and said indicia thereon are displayed in said window in said display panel, said projection means including a first projection having a first end adapted to engage said front surface of said display panel adjacent said first edge and a second end adapted to engage said front surface of said display panel adjacent said second edge.

8. A display device as set forth in claim 7 wherein said display panel further includes a third edge transverse to and interconnecting said first and second edges, and a fourth edge opposite said third edge and interconnecting said first and second edges, wherein said first projection has a side portion adapted to engage said front surface of said display panel adjacent said third edge, wherein said projection means further includes a second projection having a first end adapted to engage said front surface of said display panel adjacent said first edge, a second end adapted to engage said front surface of said display panel adjacent said second edge, and a side portion adapted to engage said front surface of said display panel adjacent said fourth edge, and wherein said first and second projections are generally parallel and adapted to support said tape therebetween.

9. A display device comprising a display panel having oppositely facing generally parallel front and back surfaces, means defining a window in said display panel, a support member having a generally planar surface arranged parallel to and opposed to said back surface of said display panel, means on said support member defining planar projection surfaces spaced along said support member and lying in a plane parallel to but spaced apart from the plane of said planar surface of said support member, said planar projection surfaces being arranged to overlap said front surface of said display panel adjacent opposite sides of said window, and said planar surface of said support member being arranged to engage said back surface of said display panel, and means on said support member defining notches between said planar projection surfaces and said planar surface of said support member sufficient to permit said support member to move relative to said display panel so that said planar projection surfaces can be selectively moved to clear said front surface of said display panel to permit removal of said support member from said display panel, and a flat continuous tape in the form of a loop, said tape having indicia on both sides thereof and being supported by said support member in said window.

* * * * *